US005372206A

United States Patent [19]

Sasaki et al.

[11] Patent Number: 5,372,206

[45] Date of Patent: Dec. 13, 1994

[54] TIGHTENING TOOL

[75] Inventors: Katsuhiko Sasaki; Yoshinori Shibata; Masaki Kondo, all of Anjo, Japan

[73] Assignee: Makita Corporation, Anjo, Japan

[21] Appl. No.: 129,307

[22] Filed: Sep. 30, 1993

[30] Foreign Application Priority Data

Oct. 1, 1992 [JP] Japan ..... 4-289654
Apr. 1, 1993 [JP] Japan ..... 5-75735

[51] Int. Cl.[5] ..... B25B 21/00

[52] U.S. Cl. ..... 173/178; 192/56 R; 81/473

[58] Field of Search ..... 173/176, 178; 81/429, 81/473, 467, 474; 192/56 R

[56] References Cited

U.S. PATENT DOCUMENTS

| | | | |
|---|---|---|---|
| 1,744,976 | 1/1930 | Levedahl . | |
| 3,187,865 | 6/1965 | Blachowski | 173/178 |
| 3,653,802 | 4/1971 | Weiss . | |
| 3,908,766 | 9/1975 | Hess | 173/178 |
| 4,071,092 | 1/1978 | Wallace | 173/178 |
| 4,630,512 | 12/1986 | Durr . | |
| 4,655,103 | 4/1987 | Schreiber et al. . | |
| 4,691,786 | 9/1987 | Fujita . | |
| 4,809,572 | 3/1989 | Sasaki . | |
| 4,883,130 | 11/1989 | Dixon . | |
| 4,966,057 | 10/1990 | Koppatsch | 173/178 |
| 4,967,888 | 11/1990 | Lippacher et al. | 173/178 |
| 5,134,909 | 8/1992 | Sasaki . | |

FOREIGN PATENT DOCUMENTS

| | | |
|---|---|---|
| 0329852 | 8/1989 | European Pat. Off. . |
| 2501189 | 2/1978 | Germany . |
| 3510605 | 10/1986 | Germany . |
| 3818924 | 6/1989 | Germany . |
| 3831960 | 3/1990 | Germany . |
| 3918227 | 11/1990 | Germany . |
| 1629165 | 2/1991 | U.S.S.R. . |

*Primary Examiner*—Scott A. Smith
*Attorney, Agent, or Firm*—Dennison, Meserole, Pollack & Scheiner

[57] ABSTRACT

A tightening tool includes a drive member rotatably driven by a motor. An intermediate member is interposed between the drive member and a spindle and rotatable with the drive member. A claw clutch is formed between the spindle and the intermediate member and is engageable when the spindle is moved axially through abutment of a bit on a work. A connecting mechanism is interposed between the intermediate member and the drive member for permitting rotation of the intermediate member relative to the drive member within a predetermined range. A biasing member normally keeps the rotational position of the intermediate member relative to the drive member. The rotation of the drive member is transmitted to the intermediate member after the drive member is rotated relative to the intermediate member by a predetermined angle when the claw clutch is engaged by movement of the spindle through abutment of the bit on the work.

12 Claims, 11 Drawing Sheets

TIGHTENING TOOL

BACKGROUND OF THE INVENTION

1. Field of the Invention

The present invention relates to a tightening tool, and particularly to a tightening tool having a silent clutch mechanism which is disengaged to stop the tightening operation upon tightening of a screw by a predetermined depth and which is kept silent during idle rotation even if a motor is continuously driven.

2. Description of the Prior Art

A conventional tightening tool having a silent clutch mechanism is disclosed in U.S. Pat. No. 4,655,103. FIG. 24 shows a view corresponding to FIG. 2*a* in this patent. The tightening tool disclosed in this patent has the following construction:

(1) The tool includes a housing, a motor, a clutch, a spindle 88 and a stopper sleeve 89.

(2) The motor, the clutch and the spindle 88 are accommodated within the housing.

(3) The stopper sleeve 89 is attached to the housing.

(4) A driver bit 90 engageable with a screw for rotation thereof is detachably mounted on the spindle 88.

(5) The driver bit 90 mounted on the spindle 88 is rotatable within the stopper sleeve 89.

(6) The spindle 88 is rotatably and axially slidably supported by the housing.

(7) The driver bit 90 is therefore slidably moved within the stopper sleeve 89 when the spindle 88 is slidably moved.

(8) The clutch mainly includes a first disc 81 rotatably driven by the motor, a second disc 84 facing to the first disc 81 and a third disc 87 fixedly mounted on one end of the spindle 88.

(9) The first disc 81 is rotatably and axially slidably supported by the housing.

(10) Clutch teeth 82 are formed on one end surface of the first disc 81.

(11) The second disc 84 is rotatably and axially slidably supported by the housing.

(12) Second clutch teeth 83 are formed on an upper end surface of the second disc 84 for engagement with the teeth 82.

(13) Recesses 85 and 86 are formed on the other end surface of the second disc 84 and on one end surface of the third disc 87 facing thereto, respectively. Each of the recesses 85 and 86 has a depth varying in a circumferential direction. More specifically, bottom surfaces 85*a* and 86*b* are connected to slant surfaces 85*a* and 86*b* each having a depth which becomes gradually shallower, respectively.

(14) The recesses 85 and 86 extend within a predetermined range in a circumferential direction and have vertical surfaces 85*c* and 86*c* at the boundary positions, respectively.

The conventional tool thus constructed is operated as follows:

(15) When the driver bit 90 is pressed on the screw, the driver bit 90, the spindle 88 and the third disc 87 are retracted together, so that the second disc 84 is also retracted.

(16) The clutch teeth 82 and the clutch teeth 83 are then engaged, and the recess 85 and the recess 86 contact each other by their bottoms 85*a* and 86*a*.

(17) A torque is transmitted from the motor to the driver bit 90 in this situation.

(18) When the second disc 84 is rotated by the first disc 81 and when the third disc 87 is subsequently rotated by the second disc 84, a contacting pressure is produced between surfaces of the recesses 85 and 86. Since each of the recesses 85 and 86 has a depth which varies in the circumferential direction, the contacting pressure forces the third disc 87 forwardly along the slant surfaces 85*b* and 86*b*.

(19) When the vertical surface 85*c* of the recess 85 and the vertical surface 86*c* of the recess 86 are brought to contact to each other, the force to move the third disc 87 forwardly is no more produced, and the tightening operation of the screw then proceeds in this situation. FIG. 24 shows such a situation.

(20) Upon tightening of the screw by a predetermined depth, the spindle 88 cannot be moved further, and the clutch teeth 82 and the second clutch teeth 83 are then disengaged from each other.

(21) When this occurs, the force of the second disc 84 to rotate the third disc 87 is no more produced, so that the second disc 84 is moved forwardly along the slant surfaces 85*b* and 86*b* of the recesses 85 and 86, resulting in that the recesses 85 and 86 contact each other at their bottoms 85*a* and 86*a*.

(22) A clearance corresponding to the depth (axial distance) of the slant surfaces 85*b* and 86*b* is consequently produced between the clutch teeth 82 and the second clutch teeth 83, and therefore, the clutch is silently idly driven without causing the teeth 82 and 83 to abut on each other.

In such a conventional tightening tool, the transmission of torque is performed through engagement of clutch teeth 82 and 83 with each other. Therefore, it involves problems in the durability of the clutch teeth and the remarkable damage and wearing of the clutch teeth. Particularly, at the beginning of the tightening operation, when the housing of the tool is pressed on a work to be tightened, the spindle 88 is retracted together with the driver bit 90 by such a pressing force, and the teeth 82 of the first disc 81 which is rotatably driven abruptly abut on the clutch teeth 83 of the second disc 84 to transmit rotation thereto. Therefore, the abutment of the surfaces of the teeth 82 and the surfaces of the teeth 83 on each other produces the problem in the durability and in the wearing.

Additionally, the conventional tightening tool is constructed such that the clutch teeth 82 on the fixed side and the clutch teeth 83 on the movable side are positively entirely disengaged from each other by movement of the second disc 84. Therefore, an additional tightening operation for further tightening the previously tightened screw cannot be performed even if the amount of tightening of the screw was insufficient as compared with a desired amount because of the inappropriate adjustment of the stopper sleeve or because of the operation at a narrow working place or on an unreliable foothold.

SUMMARY OF THE INVENTION

It is, accordingly, an object of the present invention to provide a tightening tool which permits smooth engagement of a clutch mechanism so as to prevent abrupt abutment of clutch teeth.

It is another object of the present invention to provide a tightening tool which permits the additional tightening operation when the amount of tightening is insufficient.

According to the present invention, there is provided a tightening tool comprising:

a housing accommodating a drive mechanism therewithin;

a spindle rotatably and axially movably supported by the housing, the spindle being movable in an axial direction within a predetermined range and having a forward portion for mounting a bit thereon;

a drive member rotatably driven by the drive mechanisms;

an intermediate member interposed between the drive member and the spindle and rotatable with the drive member;

a claw clutch formed between the spindle and the intermediate member and engageable when the spindle is moved axially through abutment of the bit on a work;

a connecting mechanism interposed between the intermediate member and the drive member for permitting rotation of the intermediate member relative to the drive member within a predetermined range; and a biasing member for normally keeping the rotational position of the intermediate member relative to the drive member;

whereby the rotation of the drive member is transmitted to the intermediate member after the drive member is rotated relative to the intermediate member by a predetermined angle when the claw clutch is engaged by movement of the spindle through abutment of the bit on the work.

The invention will become more fully apparent from the claims and the description as it proceeds in connection with the drawings.

DETAILED DESCRIPTION OF THE PREFERRED EMBODIMENT

A first embodiment of the present invention will now be explained with reference to FIGS. 1 to 9.

Figure 1:
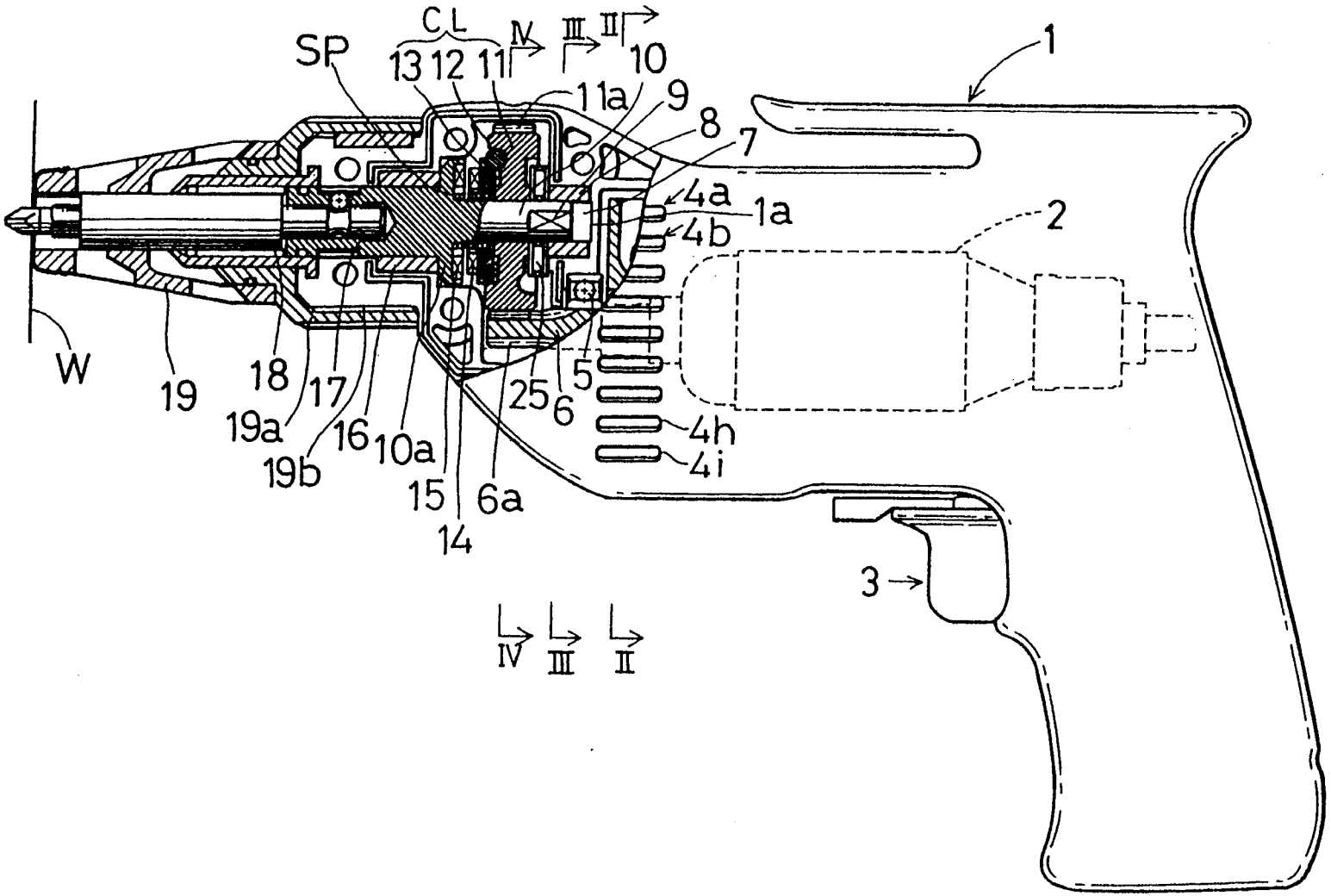
FIG. 1 is a sectional view, with a part broken away, of a power driven screwdriver according to a first embodiment of the present invention.

Referring to FIG. 1, there is shown a power driven screwdriver having a housing 1 which accommodates a motor 2, a clutch mechanism CL and a spindle 10 therewithin.

A stopper sleeve 19 is detachably mounted on a forward end of an adjust sleeve **19*b* which is mounted on a forward portion of the housing 1 through a threaded portion 19*b*. The stopper sleeve 19 is therefore slidably movable in an axial direction of the housing 1 by rotating the adjust sleeve 19*a***, and can be fixed in position at a desired position.

Figure 2:
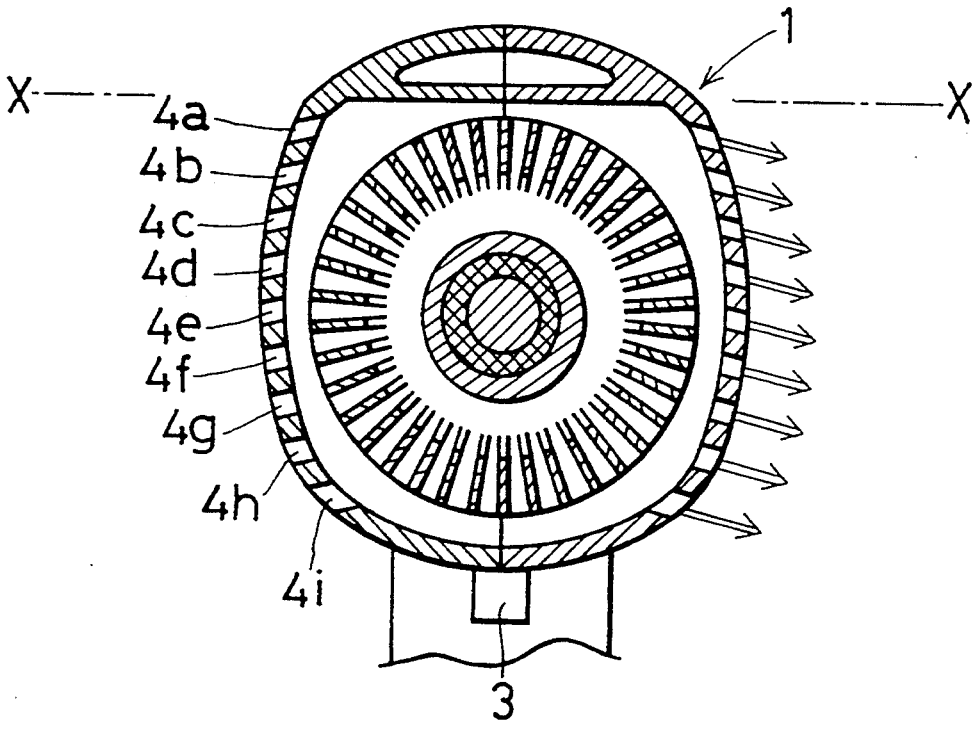
FIG. 2 is a sectional view taken along line II—II in FIG. 1.
Figure 3:
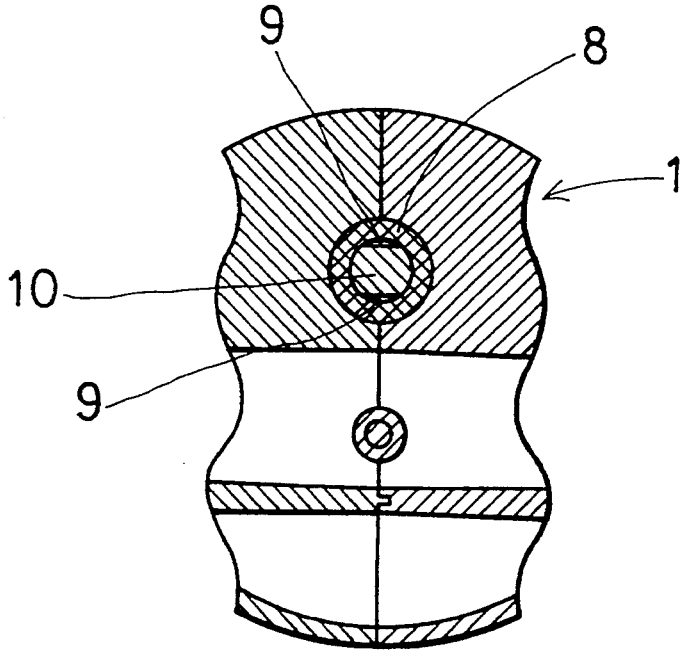
FIG. 3 is a sectional view taken along line III—III in FIG. 1.

A trigger 3 is mounted on the housing i for operation by an operator. As long as the trigger 3 is pulled by the operator, a current is supplied to the motor 2 for driving the same. Nine wind holes **4*a* to 4*i* for cooling the motor 2 are formed on each lateral side of a part of the housing 1 surrounding the motor 2. As is best shown in FIG. 2, each of the wind holes 4*a* to 4*i* is inclined on the side of the trigger 3, so that the cooling air is blown out toward the trigger 3 as indicated by arrows. Thus, the air may not blown out upwardly of level X—X. During a normal tightening operation, the face of the operator is positioned upwardly of level X—X. Therefore, the blow air may not be directly applied to the face of the operator by this orientation of the wind holes 4*a***.

As is best shown in FIG. 1, the spindle 10 is rotatably and axially slidably supported by metal bearings 8 and 16 fixed to the housing 1. The housing 1 includes a partition wall **1*a* which provides airtighteness at a position rearwardly of the metal bearing 8 for preventing entrance of foreign objects from the side of the motor 2. A space 7 is formed between the rear end of the spindle 10 and the partition wall 1*a* for permitting the axial movement of the spindle 10. The rear end of the spindle 10 is chamfered to form flat surfaces 9 at both lateral sides thereof opposed in a diametrical direction. The surfaces 9 extend forwardly beyond the forward end of the metal bearing 8, so that the space 7 is always kept in communication with the outside through gaps between the surfaces 9 and the inner surface of the metal bearing 8 even if the spindle 10 is at a retracted position (see FIG. 3). Therefore, the spindle 10 can be smoothly slidably moved within the metal bearing 8. In the conventional tightening tool, such a space 7 surrounded by the metal bearing 8, the spindle 10 and the partition wall 1*d* is closed, resulting in that the spindle 10 cannot be smoothly slidably moved since the air within the space 7 is compressed or reduced in pressure through movement of the spindle 10**.

A drive gear 11 is rotatably fitted on the spindle 10. The drive gear 11 is pressed by a compression coil spring SP on a bearing 25 so as not to be moved axially. Gear teeth 11*a* are formed on its outer periphery and are in engagement with a pinion 6*a* formed on an output shaft 6 of the motor 2. Thus, the drive gear 11 is rotatably driven by the motor 2 around the spindle 10.

Figure 4:
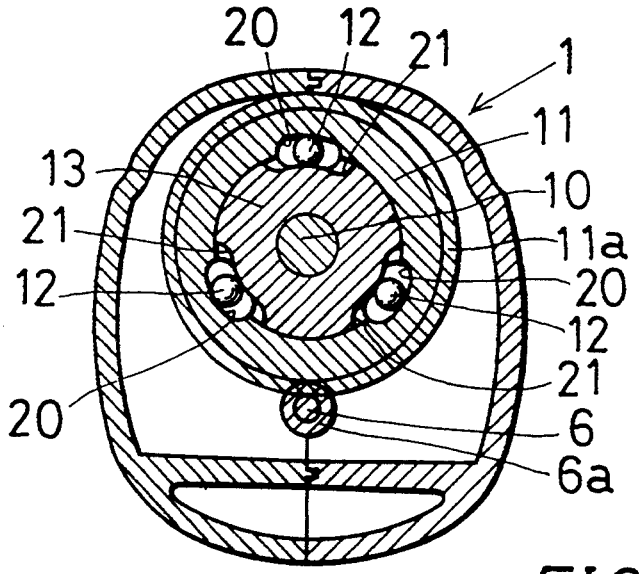
FIG. 4 is a sectional view taken along line IV—IV in FIG. 1.
Figure 5:
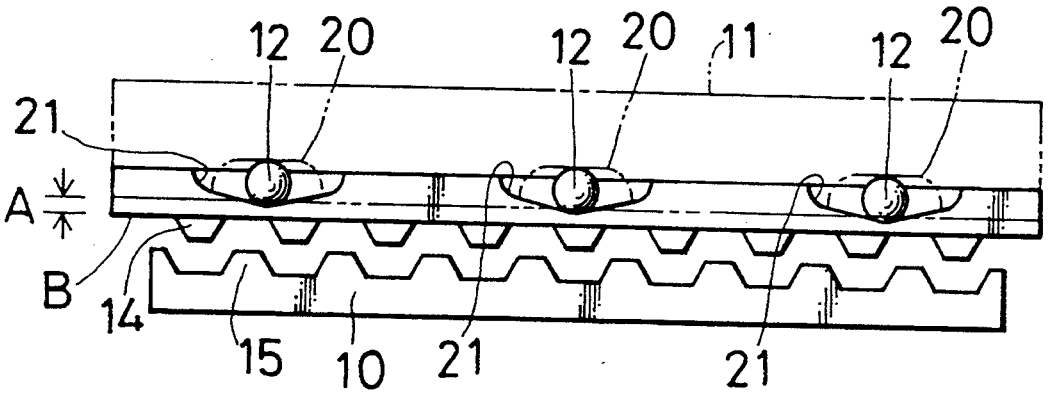
FIG. 5 is a view, in a developed form, of a drive gear, an intermediate clutch member and a spindle when no torque is produced.
Figure 6:
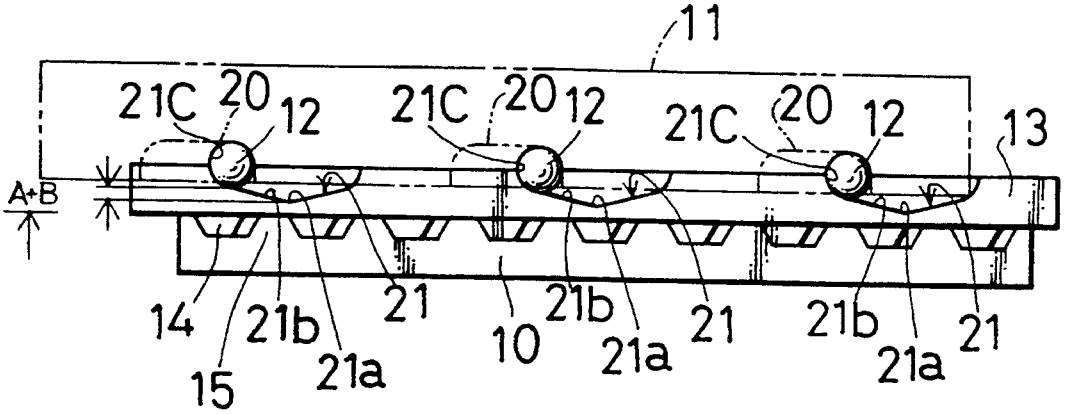
FIG. 6 is a view similar to FIG. 5 but showing the operation when a torque is produced.

Three recesses 20 are formed on a front surface of the drive gear 11 and are spaced from each other in a circumferential direction (see FIGS. 4 to 6). The circumferential length of each of the recesses 20 is twice the diameter of a steel ball 12 as will be hereinafter explained. The depth of the recess 20 is uniform in the circumferential direction. Both end walls of the recess 20 in the circumferential direction are formed to have a configuration corresponding to the curvature of the ball 12 for abutting of the ball 12 in a surface-to-surface relation. FIGS. 5 and 6 shows these recesses 20 in a form developed along the circumferential line connecting the centers of the recesses 20. In this embodiment, no clutch teeth are required for the drive gear 11, so that the drive gear 11 does not receive a substantial load. Therefore, the drive gear 11 is formed by a sintered metal to reduce manufacturing costs.

As is best shown in FIG. 1, an intermediate clutch member 13 is disposed forwardly of the drive gear 11 and is faced thereto. The intermediate clutch member 13 is slidably fitted on the spindle 10, so that the intermediate clutch member 13 can be rotatable relative to the spindle 10 and can be slidably movable in the axial direction. The intermediate clutch member 13 is biased by the spring SP in a direction toward the drive gear 11.

Three recesses 21 are formed on the rear surface of the intermediate clutch member 13 at positions facing to the recesses 20 as shown in FIGS. 4 to 6. Each of the recesses 21 has a circumferential length longer than that of the recess 20. Further, as particularly shown in FIG. 6, the recess 21 has a maximum depth (axial length) at a central position 21*a*. The depth becomes shallower in both circumferential directions away from the central position 21*a* to form inclined surfaces 21*b*. Both end walls of the recess 21 in the circumferential direction have a configuration for abutment of the ball 12 in surface-to-surface relation. The ball 12 is placed between the recess 20 and its corresponding recess 21. The ball 12 and the recesses 20 and 21 form a cam mechanism to permit rotation and axial movement of the drive gear 11 and the intermediate clutch member 13 relative to each other within a predetermined range through change of the engaging position. FIG. 5 shows the state where the ball 12 is in engagement with the recess 21 at the central position 21*a*. On the other hand, FIG. 6 shows the state where the ball 12 is in engagement with the recess 21 at its leftmost end and is in engagement with the recess 20 at its rightmost end.

In the state of FIG. 5, the ball 12 is positioned at the central position 21*a* where the depth is maximum, so that the intermediate clutch member 13 is at its most approaching position to the drive gear 11. On the other hand, in the state of FIG. 6, the steel ball 12 is moved in engagement with the recess 21 at a position having a shallowest depth, so that the intermediate clutch member 13 is moved at a position remotest from the drive gear 11 or is moved most forwardly. If the difference between the maximum depth and the shallowest depth of the recess 21 is B, the intermediate clutch member 13 is moved away from the drive gear 11 by the distance B as the state of FIG. 5 is changed to that of FIG. 6.

Here, the circumferential length of the recess 20 is enough to have at least the length corresponding to the diameter of the ball 12. Further, although, in this embodiment, the ball 12 is used as a rolling member for obtaining a smooth movement, the ball 12 may be replaced by a cylindrical pin.

As is best shown in FIG. 1, clutch teeth 14 are formed on the front surface of the intermediate clutch member 13. Clutch teeth 15 for engagement with the clutch teeth 14 are formed on the rear surface of an enlarged portion 10*a* of the spindle 10.

The clutch mechanism CL includes, as its main parts, the drive gear 11, the intermediate clutch member 13 and the steel ball 12 and is operable as will be explained later.

The spindle 10 includes an axial hole 17 on a forward portion thereof. A driver bit 18 is inserted into the axial hole 17 and is kept in position with the aid of a spring-biased stopper ball 10*b*. Thus, the driver bit 18 is rotatable and is movable in the axial direction within the stopper sleeve 19, together with the spindle 10.

The operation of the screwdriver of this embodiment will now be explained with reference to FIGS. 5 to 9.

Figure 7:
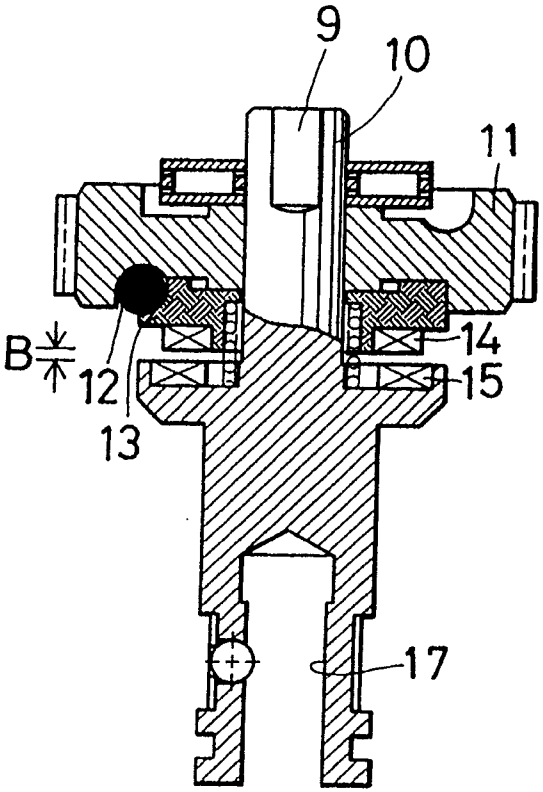
FIG. 7 is a view showing the relationship among the drive gear, the intermediate clutch member and the spindle when no torque is produced and the screwdriver is not pressed on a work.

When the motor 2 is not started and the driver bit 18 is not pressed on a screw to be driven, the spindle 10 is extended forwardly by the spring SP as shown in FIG. 7. Further, the intermediate clutch member 13 is biased by the spring SP toward the drive gear 11. Since no torque is transmitted between the drive gear 11 and the intermediate clutch member 13 at this stage, the intermediate clutch member 13 is positioned at the most approaching position to the drive gear 11 or the ball 12 is in engagement with the recess 21 at the central position 21*a* having the maximum depth.

Figure 8:
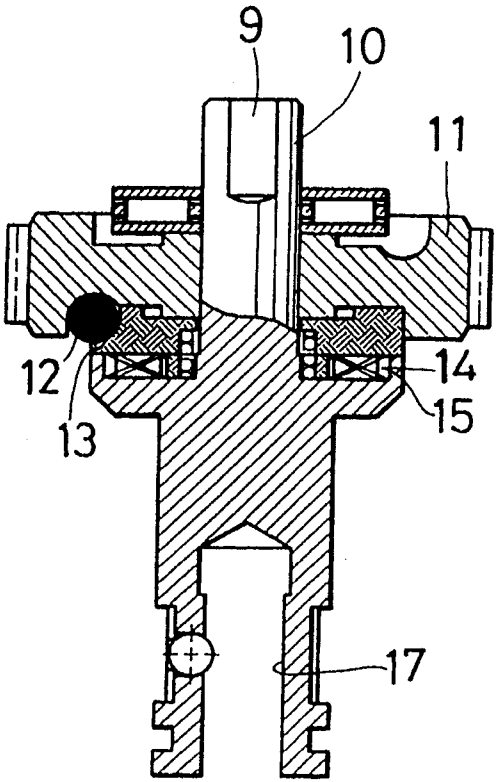
FIG. 8 is a view similar to FIG. 7 but showing the operation when no torque is produced and the screwdriver is pressed on the work.

When the operator presses the screwdriver on a work for driving operation, the spindle 10 is retracted together with the driver bit 18 (see change of state from FIG. 7 to FIG. 8). The clutch teeth 14 and the clutch teeth 15 are then engaged with each other. If the spindle 10 is retracted after the motor 2 is started, the engagement between the clutch teeth 14 and the clutch teeth 15 begins in the intermediate state between the states of FIGS. 5 and 6. It will be apparent from comparison between the states of FIGS. 5 and 6, the drive gear 11 is moved leftwardly (or is rotated) to a large extent while the intermediate clutch member 13 is not moved (or is rotated). Therefore, the clutch teeth 14 and the clutch teeth 15 begin to engage with each other when the rotational speed of the intermediate clutch member 13 is lower than that of the drive gear 11. Thus, the clutch teeth 14 and the clutch teeth 15 begin to engage with each other at a lower speed and thereafter rotate at a higher speed, so that the load applied between the clutch teeth 14 and the clutch teeth 15 is reduced. More specifically, at the beginning of the engagement of the clutch teeth 14 and the clutch teeth 15, the rotational speed of the intermediate gear 13 is lower than the rotational speed of the drive gear 11, so that the engagement can be smoothly performed and the durability of the clutch teeth 14 and 15 is thus improved. The circumferential length of the recess 20 as described above serves to permit relative rotation between the drive gear 11 and the intermediate clutch member 13, and the time of starting rotation of the intermediate clutch member 13 after the initial engagement becomes longer as the circumferential length is determined to be longer.

In order to obtain such a relative rotation, the length of the inclined surfaces 21*b* of the recess 21 may be determined to be longer. However, the length of the inclined surfaces 21*b* cannot be determined so long because of change of depth. Therefore, it is preferable to determine the length of the recess 20 to be longer.

Figure 9:
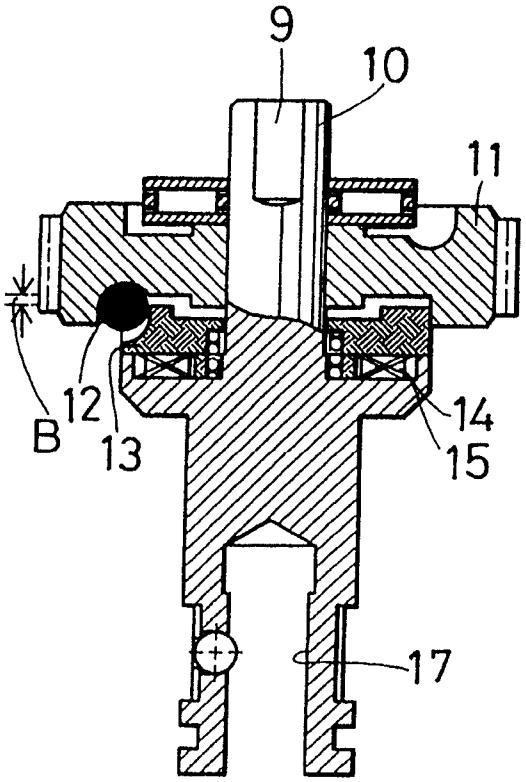
FIG. 9 is a view similar to FIG. 7 but showing the operation when the torque is produced and the screwdriver is pressed on the work.

When the force against rotation of the intermediate clutch member 13 is increased after engagement of the clutch teeth 14 and 15, the ball 12 is pressed by the rightmost end wall of the recess 20, so that the ball 12 is rolled along one of the inclined surfaces 21*b*. The intermediate clutch member 13 is therefore pushed forwardly by the distance B (depth difference) as shown in FIG. 9. The tightening operation of the screw then proceeds.

As will be seen from FIG. 1, when the forward end of the stopper sleeve 19 abuts on a work W, the force of the operator for pressing the tool on the work W becomes the abutting force of the stopper sleeve 19 on the work, and the spindle 10 is pressed forwardly only by the force of the spring SP. When the clutch teeth 14 and the clutch teeth 15 are disengaged from each other upon completion of the tightening operation of the screw by a predetermined depth, the intermediate clutch member 13 becomes free to rotate, so that it returns from the state of FIG. 6 to the state of FIG. 5.

The clearance by the distance B is then produced between the clutch teeth 14 and the clutch teeth 15, so that the clutch teeth 14 and 15 rotate idle without producing noises and that the state of FIG. 7 is recovered.

When the operator presses the driver bit 18 on a screw to be subsequently driven, the tightening operation proceeds in the state of FIG. 9, and the state of FIG. 7 is recovered upon tightening of the screw by the predetermined depth. Such an operation is thus repeatedly performed for tightening the screws to be driven.

The operation for again tightening a screw which has been insufficiently driven, so that a residual driving distance remains, will now be described. In case that the residual driving distance is less than the distance B between the clutch teeth 14 and 15 shown in FIG. 7, the stopper sleeve 19 may abut on the work W prior to engagement of the clutch teeth 14 and 15 because of retraction of the clutch teeth 15 by the distance B even if the driver bit 18 is pressed on the screw to be further driven is then retracted. In case of the prior art tool, the screw therefore cannot be tightened again unless the stopper sleeve 19 is retracted to obtain the state of FIG. 8.

According to the screwdriver of this embodiment, the state of FIG. 9 can be obtained for again tightening the screw if the operator releases the trigger 3 to stop the motor 2, and he thereafter applies the driver bit 18 on the screw to be again driven after operation of the trigger 3 to again start the motor 2. When the motor 2 is once stopped, the torque is no more transmitted between the drive gear 11 and the intermediate clutch member 13, so that the ball 12 is positioned at the central position 21*a* of the recess 21 as shown in FIG. 5 and that the intermediate clutch member 13 is retracted to the rearmost position. If the residual driving distance is small, the clutch teeth 14 and the clutch teeth 15 may not be engaged with each other to attain the state of FIG. 8 when the driver bit 18 is pressed on the screw. If the residual driving distance is equal to the clearance B, the clutch teeth 14 and the clutch teeth 15 are merely approached to each other to a position immediately before the clutch teeth 14 and the clutch teeth 15 start to engage. Thus, a larger clearance is remained as the residual driving amount becomes smaller.

On the other hand, in case of this embodiment, when the trigger 3 is operated to start the motor 2, the rotation of the intermediate clutch member 13 cannot be rapidly started because of its inertia. Therefore, the ball 12 is rolled along one of the inclined surfaces 21*b* of the recess 21 as shown in FIG. 6, so that the intermediate clutch member 13 is pushed forwardly. Thus, the state of FIG. 9 can be obtained to drive the screw for the residual driving amount without passing through the state of FIG. 8.

Although in this embodiment, the recess 20 having the uniform depth is formed on the drive gear 11 and the recess 21 having the varying depth is formed on the intermediate clutch member 13, this arrangement can be inverted. Further, the recess 21 may have a V-shaped configuration. Additionally, the number of the recesses 20 or 21 can be selectively determined. Although the clutch mechanism CL is supported by the spindle 10, a support shaft can be incorporated separately from the spindle 10 for supporting the clutch mechanism CL.

A second embodiment of the present invention will now be explained with reference to FIGS. 10 to 23. This embodiment is a modification of the first embodiment. Therefore, the same numerals are affixed to the same parts as the first embodiment, and the explanation thereof is omitted.

Figure 10:
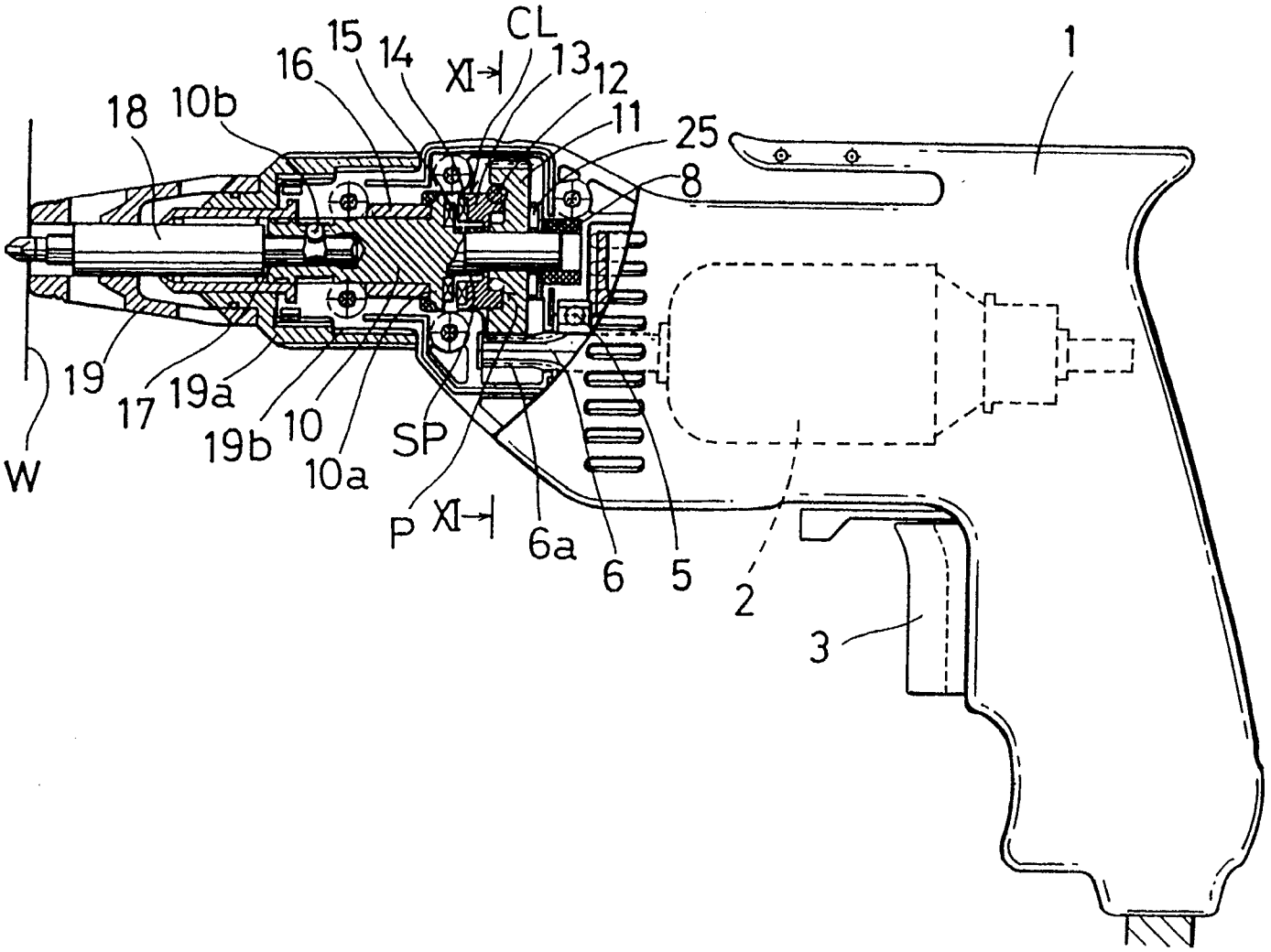
FIG. 10 is a sectional view, with a part broken away, of a power driven screwdriver according to a second embodiment of the present invention.
Figure 11:
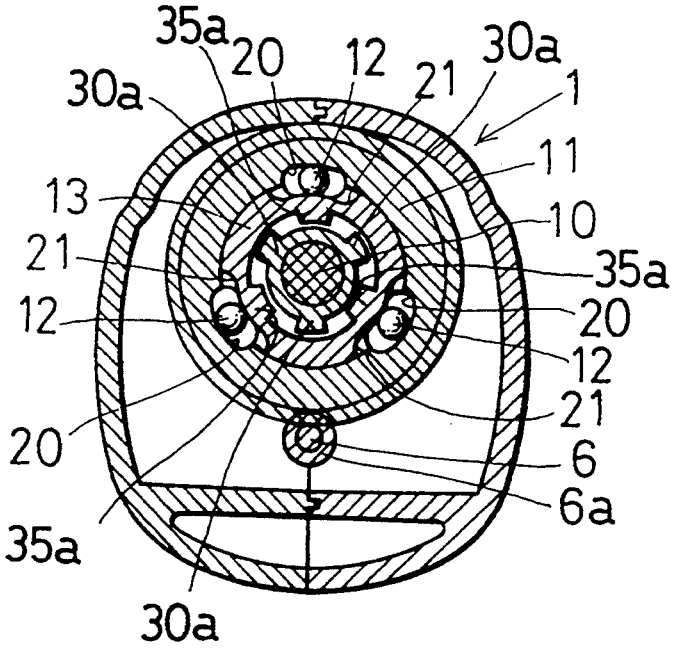
FIG. 11 is a sectional view taken along line XI—X1 in FIG. 10.
Figure 12:
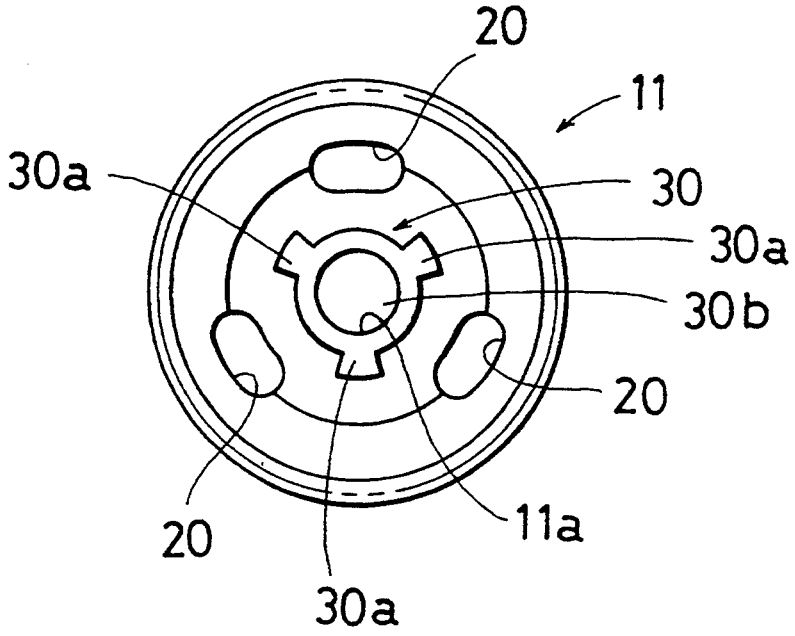
FIG. 12 is a front view of a drive gear shown in FIG. 10.

A sectional view of a power driven screwdriver according to the second embodiment is shown in FIG. 10. As shown in FIGS. 11 and 12, a power transmission mechanism P is interposed between the drive gear 11 and the intermediate clutch member 13. A drive part 30 of the power transmission mechanism P is disposed on the front end surface of the drive gear 11 on the same side as the recess 20. The drive part 30 includes a cylindrical portion 30*b* which has a hole 11*a* for insertion of the spindle 10 and extends in the axial direction by a predetermined distance from the drive gear 11. The drive part 30 further includes three power transmission teeth 30*a* each formed on an outer surface of the cylindrical portion 30*b* and having a longitudinal direction in the axial direction. The transmission teeth 30*a* protrude radially outwardly and are equally spaced from each other in a circumferential direction. Each of the transmission teeth 30*a* has a width increasing radially outwardly so as to form inclined abutting surfaces on both lateral sides in the circumferential direction. The abutting surfaces serve to abut on corresponding ones of abutting surfaces of power transmission teeth 35*a* of a driven part 35 disposed on the intermediate clutch member 13 as will be described later.

Here, the circumferential length of the recess 20 of the drive gear 11 is enough to have at least the diameter of the ball 12 as described in connection with the first embodiment. On the other hand, in this embodiment, the recess 21 is determined to have a circumferential length such that a gap 31 is still formed between the ball 12 and a corresponding one of the end walls when the power transmission mechanism P is operated as will be explained later.

Figure 13:
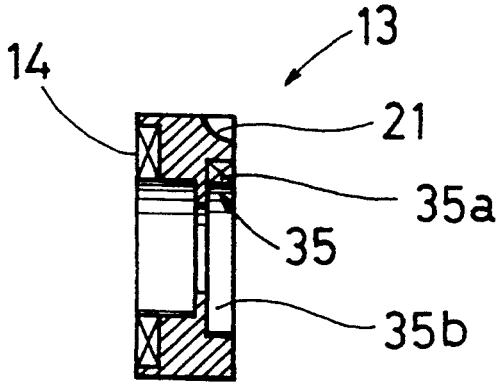
FIGS. 13 to 15 are a vertical sectional view, a front view and a rear view of an intermediate clutch member shown in FIG. 10, respectively.
Figure 14:
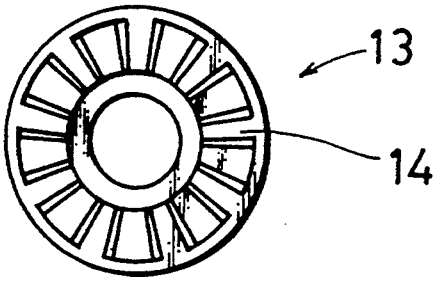
Figure 15:
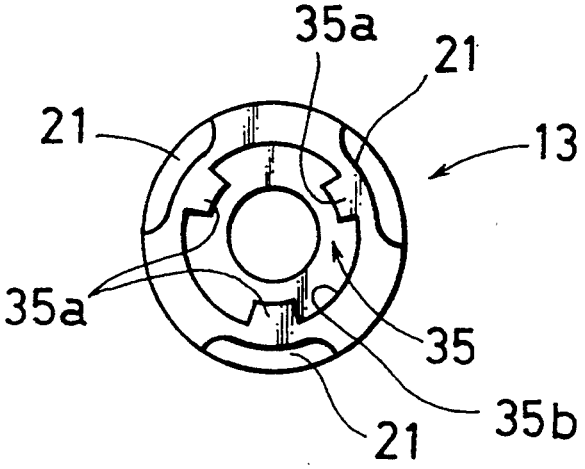

As shown in FIGS. 13 and 15, the driven part 35 is formed on the rear surface of the intermediate clutch member 13. The driven part 35 includes three transmission teeth 35*a* engageable with the transmission teeth 30*a* of the drive part 30. The intermediate clutch member 13 has a recess 35*b* for receiving the drive part 30 of the drive gear 11. The transmission teeth 35*a* protrude inwardly from the inner surface of the recess 35*b* and are equally spaced from each other in the circumferential direction (see FIGS. 11, 19 and 20).

Thus, the intermediate clutch member 13 and the drive gear 11 are arranged such that the drive part 30 of the drive gear 11 is inserted into the driven part 35 of the intermediate clutch member 13. The intermediate clutch member 13 is rotatable relative to the drive gear 11 within a movable range of the transmission teeth 35*a* of the driven part 35 each positioned between two transmission teeth 30*a* of the drive part 30.

When the intermediate clutch member 13 and the drive gear 11 are rotated relative to each other with the result that the transmission teeth 30*a* and their corresponding transmission teeth 35*a* abut on each other through their abutting surfaces in the circumferential direction, no further rotation relative to each other can be made, so that the intermediate clutch member 13 is rotated together with the drive gear 11. This operation is performed irrespective of the axial position of the intermediate clutch member 13. Thus, the power transmission mechanism P permits rotation of the intermediate clutch member 13 relative to the drive gear 11 within a predetermined range (the movable range of the transmission teeth 35*a* between two transmission teeth 30*a*). The power transmission mechanism P also permits rotation of the intermediate clutch member 13 together with the drive gear 11 after the intermediate clutch member 13 is rotated relative to the drive gear 11 by such a predetermined range with the result that the transmission teeth 35*a* abut on their corresponding transmission teeth 30*a*.

As described above, in this embodiment, the circumferential length of the recess 21 is determined such that the gap 31 is still formed between the ball 12 and the corresponding one of the end walls of the recess 21 in the circumferential direction when the intermediate clutch member 13 is rotated together with the drive gear 11 (see FIGS. 19 to 22). Thus, the rotational force of the drive gear 11 is transmitted to the intermediate clutch member 13 via the power transmission mechanism P, and the ball 12 may not be pressed on the corresponding end wall of the recess 20 and that of the recess 21. Therefore, the ball 12 applies no pressing force to the end wall of the recess 20 and that of the recess 21.

The operation of this embodiment will now be described with reference to FIGS. 16 to 19.

Figure 16:
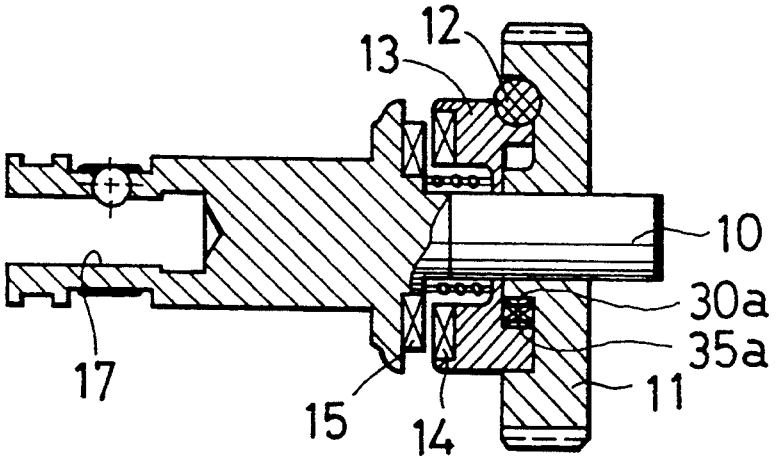
FIGS. 16 to 18 are views corresponding to FIGS. 7 to 9 of the first embodiment.

As described in connection with the first embodiment, when the motor 2 is not started and the driver bit 18 is not pressed on a screw to be driven, the spindle 10 is extended forwardly by the spring SP as shown in FIG. 16. Further, the intermediate clutch member 13 is biased by the spring SP toward the drive gear 11. Since no torque is transmitted between the drive gear 11 and the intermediate clutch member 13 at this stage, the intermediate clutch member 13 is positioned at the most approaching position to the drive gear 11 or the ball 12 is in engagement with the recess 21 at the central position 21*a* having the maximum depth (see FIGS. 11 and 21).

Further, at this stage, in the power transmission mechanism P, each of the transmission teeth 35*a* of the driven part 35 is positioned substantially the middle position between two transmission teeth 30*a* of the drive part 30.

Figure 17:
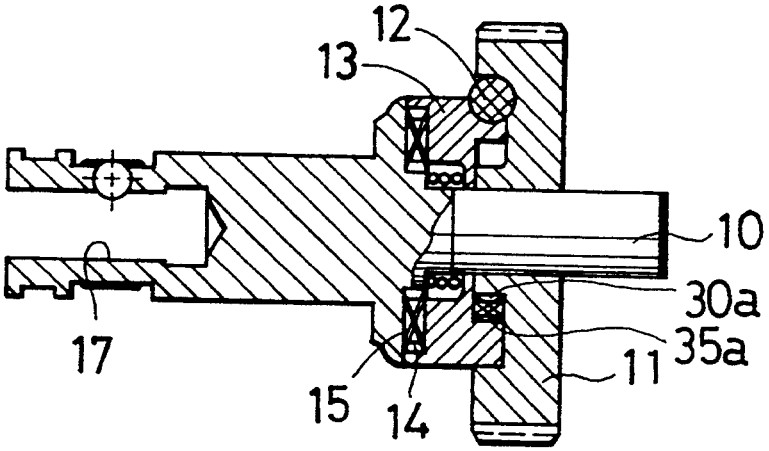

When the operator presses the tool on the work for driving operation, the spindle 10 is retracted together with the driver bit 18 (see FIG. 17). The clutch teeth 14 and the clutch teeth 15 are then engaged with each other.

Figure 18:
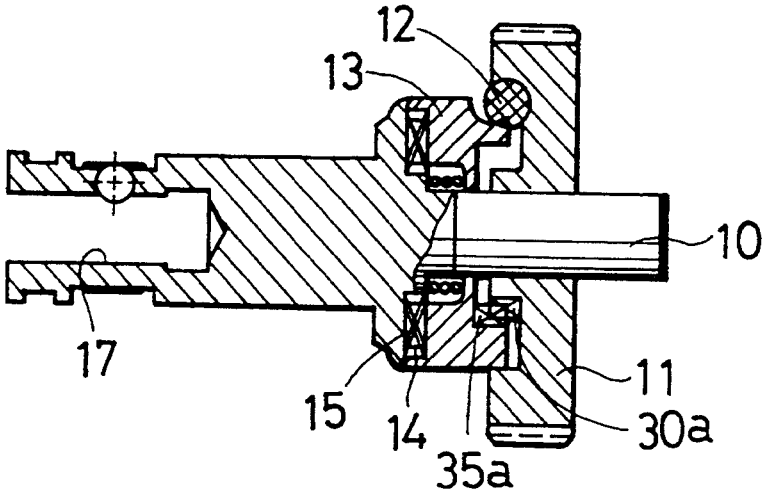
Figure 19:
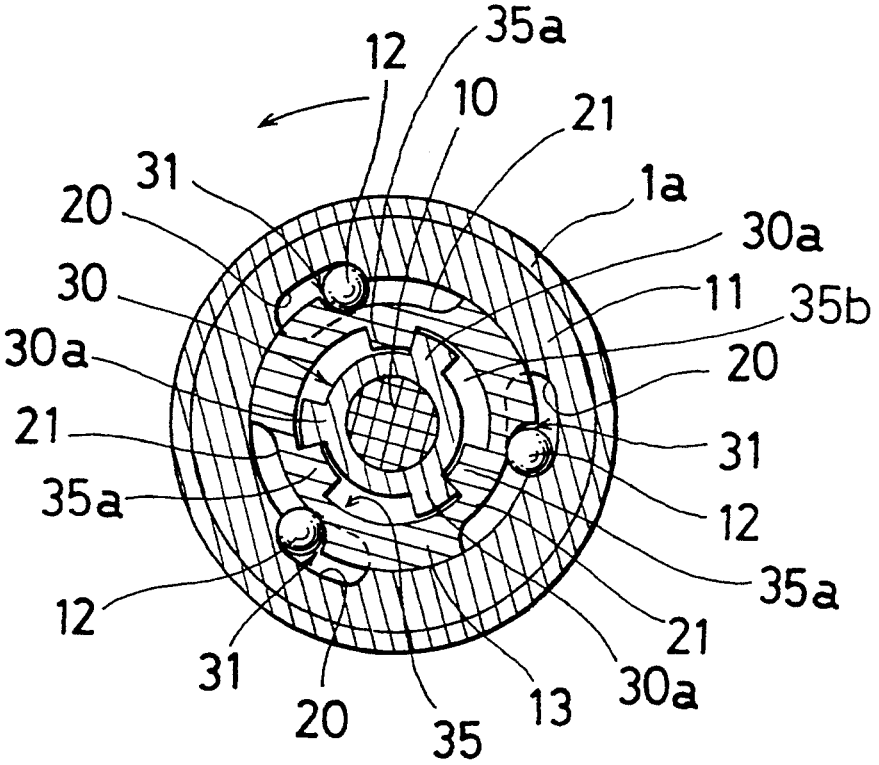
FIG. 19 is a sectional view showing the operation of a power transmission mechanism and a cam mechanism.
Figure 20:
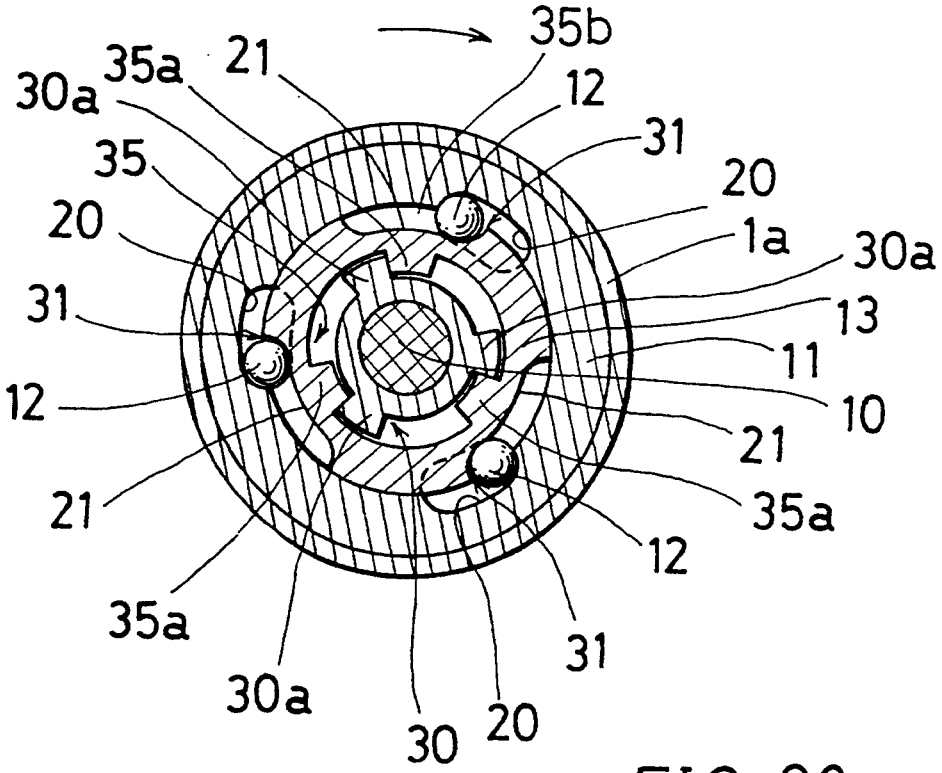
FIG. 20 is a view similar to FIG. 19 but showing a different operation.

When the operator pulls the trigger 3 with the clutch teeth 14 and the clutch teeth 15 engaged with each other, the drive gear 11 is rotated at first, and the intermediate clutch member 13 is thereafter rotated together with the drive gear 11 when the transmission teeth 30*a* abut on their corresponding transmission teeth 35*a* of the intermediate clutch member 13. With regard to the period from the time when the drive gear 11 is started to rotate to the time when the intermediate clutch member 13 is started to rotate together with the drive gear 11 or the time when the transmission teeth 30*a* abut on their corresponding transmission teeth 35*a*, as described in connection with the first embodiment, the intermediate clutch member 13 cannot rotate with the drive gear 11 because of its inertia immediately after starting rotation of the drive gear 11, and the drive gear 11 rotates relative to the intermediate clutch member 13, resulting in that the intermediate clutch member 13 is moved away from the drive gear 11 in the axial direction through cooperation of the ball 12 with the recesses 20 and 21. Thus, the clutch teeth 14 and the clutch teeth 15 are engaged with each other as shown in FIG. 18.

During the driving operation of the screw, the torque of the drive gear 11 is transmitted to the intermediate clutch member 13 only via the power transmission mechanism P. Thus, at this situation, the gap 31 is formed between the ball 12 and the corresponding end wall of the recess 21, so that no torque is transmitted via a path from the recess 20 to the recess 21 through the ball 12. Therefore, no rotational force or no tightening torque is applied to the end walls of the recesses 20 and 21, so that the end walls of the recesses 20 and 21 are prevented from damage.

As described in the first embodiment, the pressing force of the tool applied by the operator toward the work W becomes the pressing force of the stopper sleeve 19 toward the work W when the forward end of the stopper sleeve 19 abuts on the work. The clearance is therefore produced between the clutch teeth 14 and the clutch teeth 15, and the clutch teeth 14 are rotated idle without producing noises. Thus, the state returns to that of FIG. 16.

Figure 21:
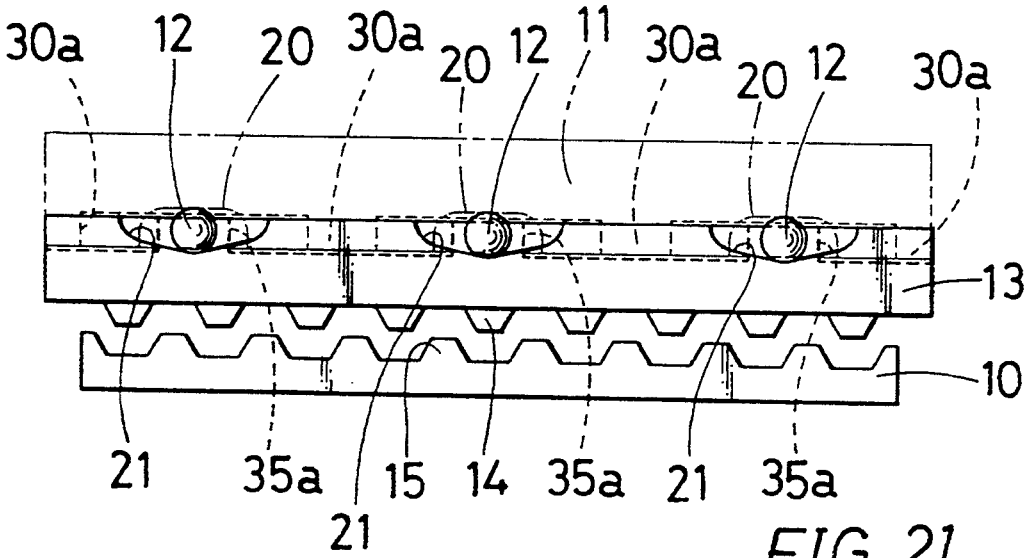
FIGS. 21 and 22 are views corresponding to FIGS. 5 and 6 of the first embodiment.
Figure 22:
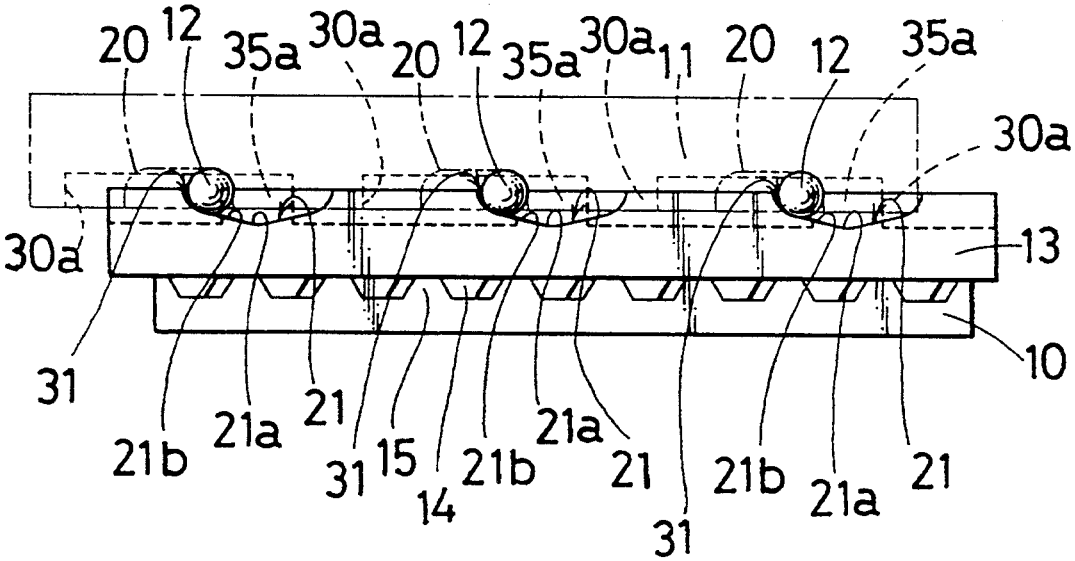

As the state returns to that of FIG. 16, the ball 12 returns to the central position 21*a* of the recess 21, and the transmission teeth 35*a* of the driven part 35 of the power transmission mechanism P also returns to the middle position between two transmission teeth 30*a* of the drive part 30 (see FIGS. 11 and 21). Therefore, at this stage, the rotational force is no more transmitted to the intermediate clutch member 13 via the power transmission mechanism P but is transmitted via the path from the recess 20 to the recess 21 through the ball 12 with the aid of the spring SP 12 which presses the steel ball 12.

In case that the tool is pressed on the screw to be subsequently driven, with the clutch mechanism CL being kept idly driven, as the spindle 10 is retracted through pressing the driver bit 18 on the screw, the clutch teeth 14 and the clutch teeth 15 are engaged with each other at the first stage. Thus, when the tightening torque is applied to the intermediate clutch member 13, the intermediate clutch member 13 is rotated relative to the drive gear 11, so that the intermediate clutch member 13 is moved forwardly. Therefore, the clutch teeth 14 and the clutch teeth 15 are engaged with each other at the middle stage between the stage of FIG. 21 and the stage of FIG. 22.

Further, when the intermediate clutch member 13 is rotated relative to the drive gear 11 through engagement of the clutch teeth 14 and the clutch teeth 15, the transmission teeth 30*a* abut their corresponding transmission teeth 35*a* (or the drive part 30 engages the driven part 35), and the tightening operation of the screw proceeds in this situation. Therefore, the rotational force of the drive gear 11 is transmitted to the intermediate clutch member 13 via the power transmission mechanism P and subsequently transmitted to the spindle 10. On the other hand, since the gap 31 is produced between the ball 12 and the corresponding end wall of the recess 21, no pressing force is applied to the end wall of the recess 20 as well as the end wall of the recess 21, so that the end walls as well as the ball 12 may not be damaged and the durability of the screwdriver is improved.

The operation of tightening of the insufficiently driven screw is the same as the first embodiment, except that the rotational force of the drive gear 11 is transmitted to the intermediate gear 13 via the power transmission mechanism P.

Thus, in this embodiment, in both the normal tightening operation and the tightening operation of the insufficiently driven screw, the rotational force of the drive gear 11 is transmitted to the intermediate clutch member 13 via the power transmission mechanism P and is not transmitted via the path from the recess 20 to the recess 21 through the ball 12.

In comparison of this embodiment with the first embodiment, the cam mechanism comprising the recesses 20 and 21 and the ball 21 serves, in the first embodiment, as a power transmission mechanism as well as a mechanism for axial movement of the intermediate clutch member 13, while the cam mechanism in the second embodiment serves only as the mechanism for movement of the axial direction of the intermediate clutch member 13, and the transmission of power is performed by the power transmission mechanism P.

Figure 23:
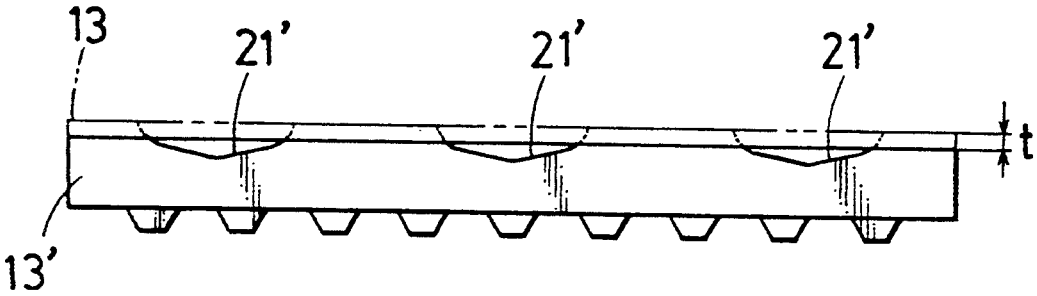
FIG. 23 is a view, in a developed form, an intermediate clutch member according to a modification of the second embodiment.
Figure 24:
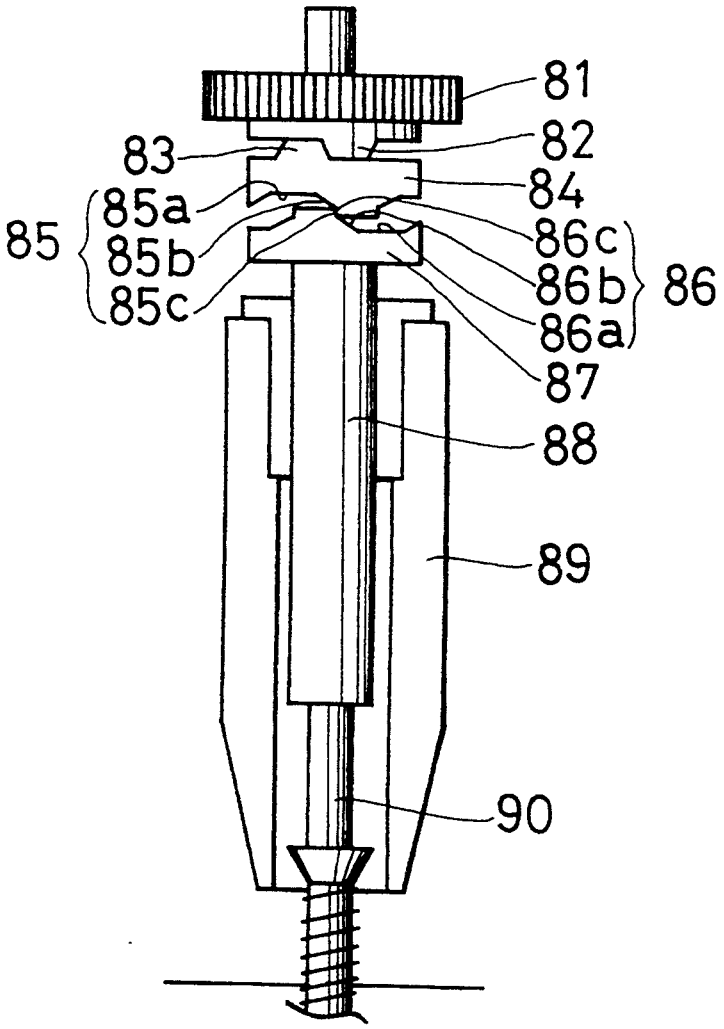
FIG. 24 PRIOR ART
FIG. 24 is a view of a prior art tightening tool.

Further, since the end walls of the recesses 20 and 21 do not receive the rotational force in the second embodiment, the recess 21 may be formed as a recess 21' shown in FIG. 23. Thus, the recess 21' corresponds to the recess 21 eliminating the end walls for abutment of the ball 12 and has a narrower depth compared with the recess 21. In connection with this, an intermediate clutch member 13' (or a drive gear) having the recess 21' may have a lesser thickness than the intermediate clutch member 13 by a length t. Therefore, the screwdriver can be constructed to have a smaller size.

An important feature of the second embodiment i s that the cam mechanism for the axial movement of the intermediate clutch member 13 does not receive a substantial force for transmission of power from the drive gear 11 to the intermediate clutch member 13, so that the setting or the damage to the cam mechanism is reduced.

While the invention has been described with reference to preferred embodiments, it is to be understood that modifications or variations may be made without departing from the spirit of this invention which is defined by the appended claims.

What is claimed is:

1. A tightening tool comprising:

a housing accommodating drive means therewithin;

a spindle rotatably and axially movably supported by said housing, said spindle being movable in an axial direction within a predetermined range and having a forward portion for mounting a bit thereon;

a stopper sleeve mounted on a forward end of said housing for receiving said bit therewithin;

a drive member rotatably driven by said drive means;

an intermediate member interposed between said drive member and said spindle and disposed coaxially with said drive member;

a claw clutch mechanism interposed between said spindle and said intermediate member and including a plurality of first clutch teeth formed on said spindle and a plurality of second clutch teeth formed on said intermediate member;

connecting means interposed between said intermediate member and said drive member for transmitting rotation of said drive member to said intermediate member;

said connecting means including biasing means and cam means, said biasing means being operable to normally keep said intermediate member at a first position relative to said drive member, said cam means being operable to permit movement of said intermediate member against the biasing force of said biasing means from said first position to a second position when said bit is pressed on a work during rotation of said drive member so as to bring said first plurality of clutch teeth of said spindle in engagement with said second plurality of clutch teeth of said intermediate member through movement of said spindle;

said second position being displaced from said first position by a predetermined angle in the rotational direction and displaced axially from said first position in such a direction that said second plurality of teeth of said intermediate member is moved toward said first plurality of clutch teeth of said spindle;

so that the rotation of said drive member is transmitted to said spindle after said intermediate member is rotated by said predetermined angle when said bit is pressed on the work during rotation of said drive member; and said intermediate member returns to said first position due to the biasing force of said biasing means when said first and second clutch teeth are disengaged from each other upon abutment of said stopper sleeve on the work to terminate the tightening operation.

2. The tightening tool as defined in claim 1 wherein said cam means includes a first recess, a second recess and an engaging member for being partly received by said first and second recess; said first recess is formed on said intermediate member; said second recess is formed on said drive member at a position facing said first recess, and at least one of said first and second recesses permits movement of said engaging member in the rotational direction and the recesses have a depth in the axial direction which varies in a circumferential direction.

3. The tightening tool as defined in claim 2 wherein said engaging member is a ball.

4. The tightening tool as defined in claim 2 wherein a plurality of said cam means are provided and the cam means are equally spaced from each other in the circumferential direction.

5. The tightening tool as defined in claim 1 wherein said biasing means is a spring for normally biasing said intermediate member toward said drive member.

6. The tightening tool as defined in claim 1 wherein said drive member and said intermediate member are rotatably supported by said spindle; and said intermediate member is moved in the axial direction along a longitudinal direction of said spindle.

7. The tightening tool as defined in claim 1 wherein said first and second plurality of clutch teeth have configurations tapered toward each other, so that each of said first and second clutch teeth are disengaged from each other when said stopper sleeve abuts the work.

8. The tightening tool as defined in claim 1 and further including power transmission means which is operable to directly transmit rotation of said drive member to said intermediate member without intervention of said connecting means when said intermediate member is rotated relative to said drive member after engagement of said claw clutch mechanism by movement of said spindle through abutment of said bit on the work.

9. The tightening tool as defined in claim 8 wherein said drive member and said intermediate member are rotatably supported by said spindle; said power transmission means includes a first protrusion and a second protrusion formed on said drive member and said intermediate member, respectively; and said first and said second protrusions abut on each other when said drive member is rotated by said predetermined angle.

10. The tightening tool as defined in claim 9 wherein said drive member includes a cylindrical portion for insertion of said spindle; said cylindrical portion extends toward said intermediate member; said intermediate member includes a cylindrical inner surface facing to an outer peripheral surface of said cylindrical portion and spaced therefrom by a predetermined distance; said first protrusion is formed on said outer peripheral surface of said cylindrical portion of said drive member; and said second protrusion is formed on said inner surface of said intermediate member.

11. The tightening tool as defined in claim 10 wherein a plurality of said first protrusions and a plurality of said second protrusions are provided and are equally spaced from each other in a circumferential direction.

12. The tightening tool as defined in claim 10 wherein said cam means is provided between an outer peripheral part of said intermediate member and a part of said drive member facing said outer peripheral part.

* * * * *